United States Patent [19]

Ziller et al.

[11] Patent Number: 4,606,527

[45] Date of Patent: Aug. 19, 1986

[54] THEATRE SCENERY HOISTING MECHANISM

[75] Inventors: Alexander Ziller, Luisenstrasse 11, D-4230 Wesel; Helmut Grosser, Andreas-Herz-Strasse 7, D-8011 Baldham, both of Fed. Rep. of Germany

[73] Assignees: Alexander Ziller; Helmut Grosser; Richard E. Nicholson; Vince Silveri, all of East Bloomfield, N.Y.

[21] Appl. No.: 684,455

[22] Filed: Dec. 21, 1984

[30] Foreign Application Priority Data

Dec. 29, 1983 [EP] European Pat. Off. ..... 83201850.1

[51] Int. Cl.[4] ..... A63J 1/02; B66D 1/12

[52] U.S. Cl. ..... 254/336; 272/21; 272/24

[58] Field of Search ..... 254/335, 336, 337, 338, 254/413; 272/21, 24

[56] References Cited

U.S. PATENT DOCUMENTS

| | | | |
|---|---|---|---|
| 1,255,193 | 2/1918 | Pierce | 254/338 X |
| 1,747,916 | 2/1930 | Volland | 272/21 |
| 2,649,279 | 8/1953 | Jones et al. | 254/338 X |
| 3,345,066 | 10/1967 | Izenour | 272/24 X |

FOREIGN PATENT DOCUMENTS

| | | | |
|---|---|---|---|
| 1542722 | 9/1968 | France | 254/338 |
| 662481 | 5/1979 | U.S.S.R. | 272/24 |
| 735559 | 5/1980 | U.S.S.R. | 254/336 |

*Primary Examiner*—Donald Watkins

*Attorney, Agent, or Firm*—Samuel R. Genca

[57] ABSTRACT

For raising and lowering theatre scenery there is a horizontal track in the fly loft of the theatre, and several carriages, slidable along the track, are shiftable to any desired positions along the track, positions being chosen in accordance with possibly uneven or non-uniform weight distribution in the scenery to be handled. A series of cables, one for each carriage, runs from a common winding drum to one end of the track and then to an anchorage at the opposite end of the track. Each cable runs over two pulleys of its own individual carriage, and forms a downwardly extending loop between these two pulleys. A pulley block rides on each loop. All the pulley blocks are ordinarily connected to a scenery batten, from which the scenery is hung, but when specially required, individual pulley blocks may be used separately. Under no-load or minimum load conditions, the carriages may be easily moved along the track to place them in desired position, simply by manually pulling downwardly on one or the other of the two sections or reaches of the cable coming down from the carriage pulleys to the pulley block, the blocks having been lowered, of course, to a convenient working height close to the stage. Under normal load conditions, when the weight of scenery is suspended from the blocks, friction holds the carriages against movement.

5 Claims, 3 Drawing Figures

THEATRE SCENERY HOISTING MECHANISM

The present invention relates to mechanism for raising and lowering theatre scenery.

In theatres, opera houses, concert halls, and the like, it is the common practice to have a high loft area, often called the fly loft, directly over the stage, and to have means for raising and lowering horizontal members, called battens, from which backdrops, borders, and other scenery elements are hung. When a particular scenery element is not wanted for a particular scene of a performance, it is "flied" upwardly into the fly loft, sufficiently high so that the lower edge of the scenery element is above the field of view of the audience. It is lowered from the fly loft to a visible position, of course, when required. Not all scenery changes are made by flying the scenery element, but many are.

These upward and downward movements of scenery should be made as quickly and effortlessly as possible. For that purpose, various scenery hoisting arrangements have been developed, and are in use in the art. However, the known arrangements have various drawbacks and disadvantages, especially when a scenery element to be attached to a batten is substantially heavier at one point along the length of the batten than at another. In the scenery hoisting mechanisms commonly used, the hoisting lines are attached to the battens at fixed locations at uniform intervals along the lengths of the battens. This usual arrangement is appropriate only if the weight of the scenery suspended from the batten is distributed uniformly along the length of the batten.

However, it often happens that the scenery item or element attached to a particular batten is not of uniform weight along the length of the batten, but may vary greatly at different points along the batten. This variation in weight may produce undue stress in the ropes or other lifting elements attached to the batten at or near the points where the scenery is heavy, perhaps stressing such elements even beyond their safe load limit. In the conventional scenery handling equipment, there is no way, or at least no easy and convenient way, in which the points of connection of the ropes or lifting elements to the batten may be shifted to make the location of the connection points more appropriate to scenery of non-uniform weight in a direction across the stage, to provide more lifting elements spaced closer together where the scenery is heavier and fewer elements, spaced farther apart, in locations where the scenery is lighter, so that the total weight of the scenery is more evenly distributed among the various lifting elements attached to that particular batten.

In large theatres, stages may be 30 meters or more in width (90 or 100 feet or more). Some pieces of scenery to be "flied" into and out of the fly loft may extend only part way across the full width of the stage, others may extend all the way across. Depending on the scene depicted, and on the embellishments or accessories attached to a particular piece of scenery and intended to be raised and lowered with it, there may be a considerable variation in weight at different points in a direction across the stage of the threatre, especially with large pieces of scenery in large theatres. The total load to be hung from a particular batten may be, e.g., from 200 to 1000 or more kilograms (440 to 2200 pounds or more). Thus it is seen that for the sake of both efficient operation and safety against overload, the hoisting mechanism installed in a fly loft of a theatre or similar location should be very versatile, and easy to shift from one configuration to another.

The object of the present invention is to provide a theatre scenery hoisting mechanism which is improved and more satisfactory in general, and in particular is especially advantageous in situations where the weight or load on a particular batten varies at different points along the length of the batten. The invention provides an arrangement in which the hoisting connections to the batten may be easily and quickly shifted to different points along the length of the batten so that the different hoisting connections (usually several on each batten) may be attached at those points which will give approximately uniform distribution of load among the different hoist connections even though the load varies at different points along the batten.

SUMMARY OF THE INVENTION

This object is achieved by providing a guide rail or track parallel to and above the position of each batten when it is raised to its maximum height, and a series of sliding carriages supported by and movable along this track, there being one carriage for each desired point of attachment of the lifting elements to the batten. Each carriage has two pulleys or sheaves. There are a number of cables or ropes, preferably one for each carriage. There is a windlass or winding drum, preferably motor driven, on which the respective cables or ropes are wound. The cables go from the windlass to guide pulleys near one end of the track, then extend along the track to the respective carriages. Each cable runs over the first pulley of its individual carriage, then downwardly to and around a pulley which may be referred to as a block pulley or a block, then upwardly to the second pulley of the same individual carriage, and then horizontally along the track to an anchorage at the far end of the track. Each pulley block is connected to the batten by connecting means which is easily movable along the length of the batten. The points of connection to the batten are determined by the weight distribution of the particular scenery which is to be supported by that batten, using more connections closer together where the weight is greater, so as not to overload any one connection, and connections farther apart where the weight of the scenery is lighter. The pulley carriages are moved along the guide rail or track to locations corresponding to the spacing desired for the connections to the batten, and the respective pulley locks are connected to the batten at the desired points. Under slack or no-load conditions, the carriages are easily moved along the guide track simply by manually pulling down on one reach or the other reach of the cable coming down from that particular carriage to its block (the blocks having been lowered to accessible position close to the stage floor) but under load conditions, the blocks are held in position by friction and do not travel along the track. Under load conditions, the pull of the cable going to the windlass or winch, tending to pull the carriage in one direction, is balanced by the pull in the opposite direction of the end of the cable going to the anchorage, hence there is no substantial force tending to move the carriage along the track, and friction is sufficient to hold it in the position in which it has been set.

As another illustration of the versatility of this mechanism, it may be mentioned that the apparatus may be used also for lifting heavy articles on the stage. For example, if a heavy "prop" on stage needs to be lifted to place it in a new location or onto a dolly or hand truck, a pulley block can be disconnected from the batten to which it is normally connected, and can be connected to the prop which is to be lifted. It may be noted that the lifting capacity of each block is double the load capacity of the individual cable, because of the block-and-tackle effect of the two reaches of cable going through the block. If this double capacity is still not enough for lifting a particularly heavy object on the stage, two or more pulley carriages may be placed close together on the track, and the blocks of both (or more) of the carriages may all be connected to the same heavy piece to be raised.

BRIEF DESCRIPTION OF THE DRAWINGS

A preferred embodiment of the invention is illustrated in the accompanying drawings, in which.

DETAILED DESCRIPTION OF THE PREFERRED EMBODIMENT

Figure 1:
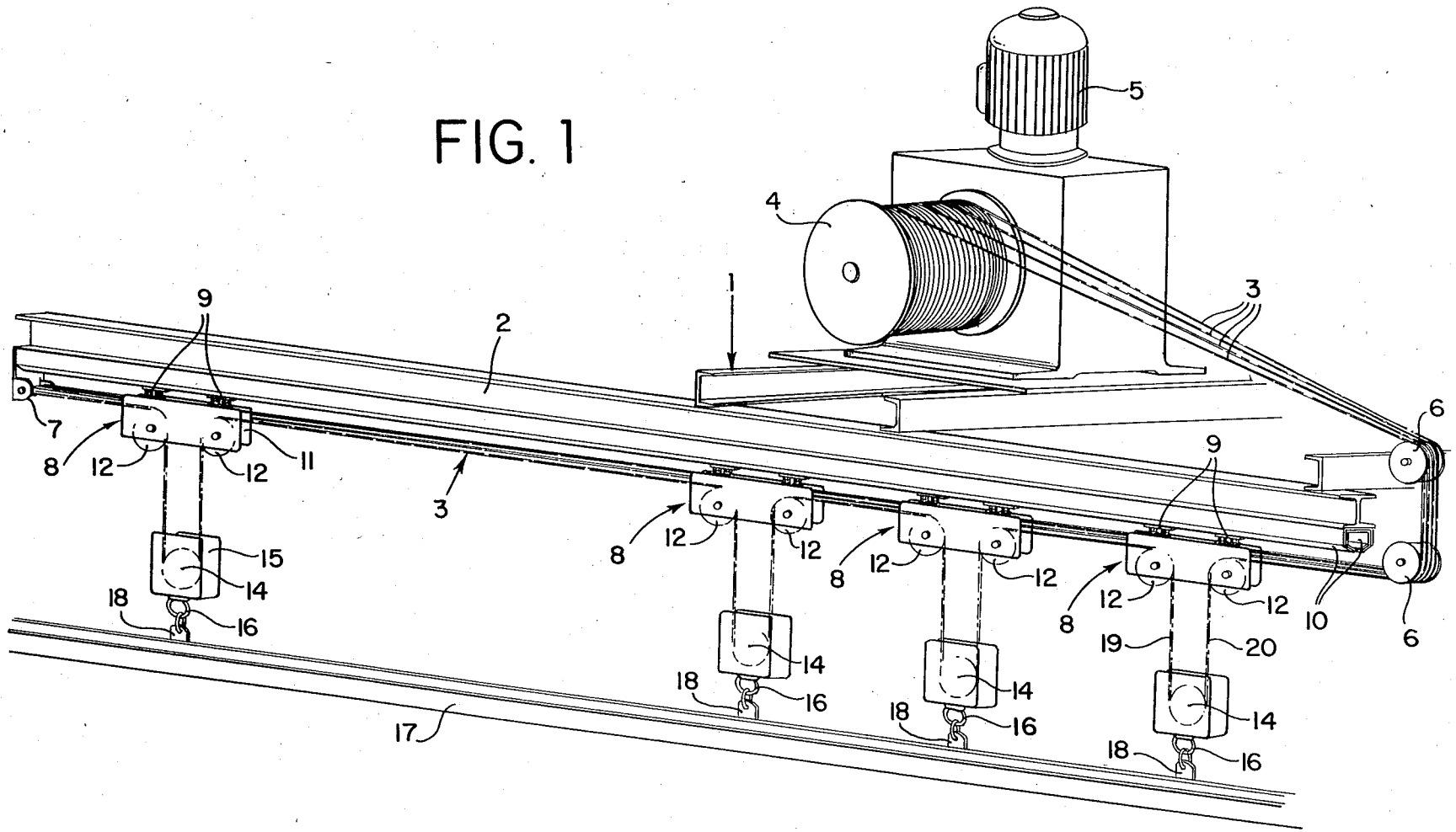
FIG. 1 is a perspective view of a hoisting installation in accordance with the invention, with some parts omitted and some parts shown schematically.

Referring now to the drawings, there is shown a fragment of a conventional stationary framework or support 1 in the fly loft of a theatre or the like. Supported from this framework 1, or in any other suitable way, is a guide rail or track 2, extending in a direction across the width of the stage. There will usually be several of such guide rails arranged parallel to each other, each with its own separate hoisting mechanism, so that various different items of scenery may be raised and lowered independently.

For performing the hoisting of whatever is hung from a particular guide rail or track, there are several cables or ropes 3 which collectively form a group or range of cables, all the cables of the group being wound on the same drum or windlass 4, which may be operated manually if desired, but preferably is operated by an electric motor 5. As already mentioned above, the lifting mechanism operates with a block-and-tackle effect so that the pulling force needed on the cables for a given weight is only half of what it would be without the block-and-tackle effect, and therefore the driving motor 5 can be made correspondingly smaller and lighter.

The cables 3 run from the windlass 4 over guide pulleys 6 near one end of the track 2, and thence along under the track to the respective pulley carriages to be described later, and on beyond the carriages to a secure anchorage 7 at the opposite end of the track 2. On the track are any desired number of pulley carriages or slide carriages, each indicated in general at 8. Four such carriages on the track are illustrated in FIG. 1, but there could be more or less, depending on the length of the track and the expected maximum weight of scenery to be suspended from this particular track. Since there is one cable for each carriage, there are four cables in the group illustrated in FIG. 1.

Figure 3:
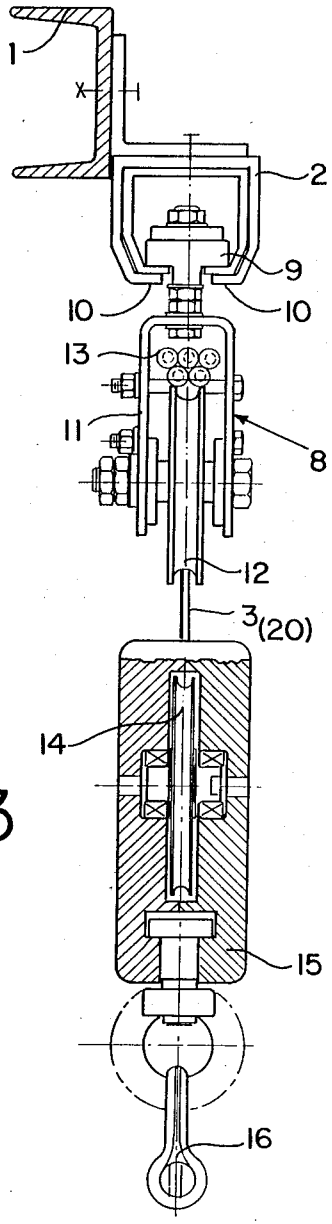
FIG. 3 is a vertical section through the parts shown in FIG. 2, taken on a plane at right angles to the plane of FIG. 2.
Figure 2:
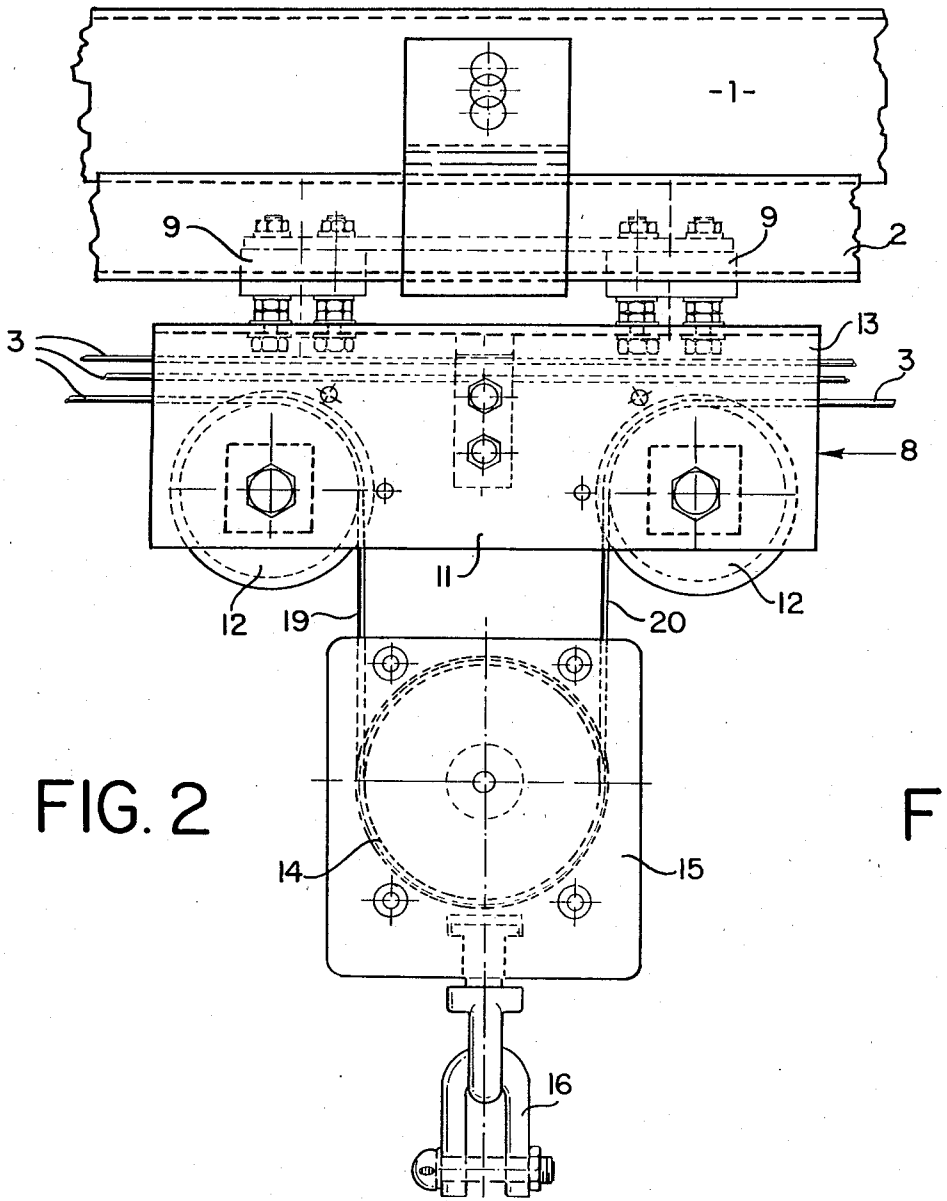
FIG. 2 is a fragmentary elevational view showing a portion of the track and one of the pulley carriages and its associated pulley block and other parts.

The track or rail 2 is formed with inwardly directed bottom flanges 10 with a space between them. Each carriage 8 has two slide members or shoes 9 of T-shaped cross section (see FIG. 3) which are supported by and can slide along these flanges 10 of the track. The two shoes of each carriage are rigidly connected by a top plate overlying the shoes within the hollow space of the track (see FIGS. 2 and 3) and by a housing 11 of inverted U-shape suspended below the track. As best seen in FIG. 2, bolts go down through the top plate, through the slide shoes, and through the top wall of the housing 11.

Mounted for rotation within the housing 11 are two pulleys or sheaves 12, spaced from each other in the direction of the track. These pulleys rotate in the vertical plane of the track. The dimensions of the housing 11 are such that space 13 is provided above the pulleys 12 for passage of the other cables of the group, which service other carriages. The cable serving this particular carriage goes over the first pulley 12, then downwardly to a pulley block described below, then upwardly to the second pulley 12 and on horizontally to the anchorage, whereas the other cables of the group, serving other carriages on the same rail or track, pass straight through the space 13 in the upper part of the carriage, and are supported against sag by a cross bolt or the like.

A block pulley 14 rides on the loop of the cable extending downwardly between the two carriage pulleys 12. This pulley 14 is mounted in a block 15 of sufficient weight to keep the cable taut and to insure that when the cable is played out from the drum 4, the block will descend by gravity. Supported from the block 15 at its bottom is a suitable attachment device, such as a ring and a companion clevis 16, for supporting any desired object from the block. Usually the object to be supported is a scenery battan 17 (FIG. 1) equipped with suspension elements 18 slidable to any desired position along the length of the batten and connectable to the respective clevises 16 of the respective blocks associated with the respective carriages 8.

The suspension elements 18 on the batten are moved to locations appropriate to the distribution of weight to be supported by the batten, and the hoisting carriages 8 are moved along the track to corresponding locations. When setting up the mechanism for handling a particular item of scenery, the cables are played out from the drum until the blocks 15 are at a convenient working height of, say, about three feet above the stage floor. With the cables then in no-load condition (or only the slight load caused by the weight of the respective blocks 15) it is very easy to move the carriages 8 along the track 2 to any desired position. A manual downward pull on the left-hand downward section or reach 19 of a cable will move its slide carriage 8 leftwardly along the rail, and a downward pull on the right-hand section or reach 20 of the cable will move its carriage to the right. As already indicated, hoisting positions are chosen depending on the weight of the scenery to be attached to the batten. The configuration illustrated in FIG. 1, with three hoisting carriages relatively close to each other at the right half of the track and only one carriage at the left, would be appropriate for use if the right-hand portion of the scenery attached to the batten is relatively heavy and the left-hand portion thereof is relatively light. The scenery is attached to the batten in the customary conventional manner, and the batten is raised or lowered as required, by operation of the motor 5 or other appropriate power applied to the windlass or drum 5.

Beside providing for adjustment of the lifting points to accommodate unequally loaded battens, the movability of the suspension or lifting points has other advantages. For example, after removing the batten, the pulley blocks 15 may be employed as individual lifts for scenery items or props. This may be very advantageous especially when the arrangement of items on the stage is such that there is no clear space in the vertical plane of movement of a batten, but space can be found for one or more individual lifting lines. This offers considerably increased possibilities of variations for arrangement of theatrical stage settings.

For operation of the cable lines, it is preferred to wind all the lines of all the carriages of a single track onto a single windlass or drum. However, it is within the scope of the invention to wind each individual cable on its own separate windlass or drum. It is also within the scope of the invention to use vertically movable counterweights for operating the cables, instead of winding them on one or more drums.

What is claimed is:

1. Theatre scenery hoisting mechanism comprising:

(a) framework means forming a track substantially extending horizontally at an elevation above a stage, (b) a plurality of carriages moveable along said track, each of said carriages having (i) a housing, (ii) frictional shoes connected to said housing and being in sliding frictional cooperative relationship with said tract for selectively sliding said carriage serially along said tract to selected positions along said track, and (iii) first and second pulleys rotatably mounted within said housing at substantially equal elevations above said stage, (c) a plurality of operating cables, each one of said cables corresponding to a given one of said carriages, (i) all of said cables being fixed at one end thereof to a point near one end of said longitudinal track, (ii) all of said plurality of cables extending through all of said housings of said carriages, (iii) each said cable in said plurality of cables corresponding to a given one of said carriages being disposed over said first and second pulleys of said given one of said carriage and having a downwardly extending loop between said first and second pulleys, (d) a plurality of pulley blocks, one riding on said loop associated with each of said carriages, and (e) means for applying a pulling force to all of said cables in said plurality of cables at the same time thereby simultaneously raising said pulley blocks and raising theatrical scenery suspended from said pulley blocks.

2. The invention defined in claim 1, wherein said track includes two approximately horizontal flanges with a slot between them, and each of said frictional shoes of said carriages includes a T-shaped portion with a head slidable along and supported from said flanges.

3. The invention defined in claim 1, wherein said housing is of inverted U-shaped cross section having two diametrically opposed side walls, said first pulley and said second pulley being mounted between said two side walls of said housing, said housing also including a cross-member between said two side walls at an elevation above the tops of said first and second pulleys for supporting said cables extending through said carriages.

4. The invention defined in claim 1, wherein said means for applying a pulling force includes a cable winding drum, all of said cables being wound on said drum for applying said pulling force on all of said cables.

5. The invention defined in claim 1, further comprising a scenery batten for supporting scenery, a plurality of connecting elements movable along said batten to selected positions, and means for connecting each of said connecting elements to one of said pulley blocks, whereby all of the pulley blocks collectively, arranged in any longitudinal spacing desired, may be used to raise and lower said batten and any theatrical scenery attached thereto.

* * * * *